US006533129B2

(12) United States Patent
Bassi

(10) Patent No.: US 6,533,129 B2
(45) Date of Patent: Mar. 18, 2003

(54) MOVABLE RACK FOR AN ELECTRIC HOUSEHOLD APPLIANCE

(75) Inventor: Alberto Bassi, Turin (IT)

(73) Assignee: ITW Industrial Components S.r.l., Milan (IT)

( * ) Notice: Subject to any disclaimer, the term of this patent is extended or adjusted under 35 U.S.C. 154(b) by 0 days.

(21) Appl. No.: 09/827,364

(22) Filed: Apr. 6, 2001

(65) Prior Publication Data

US 2001/0047969 A1 Dec. 6, 2001

(30) Foreign Application Priority Data

Apr. 7, 2000 (IT) ..... MI00A0760

(51) Int. Cl.[7] ..... A47G 19/08; A47F 5/00

(52) U.S. Cl. ..... 211/41.8; 211/181.1; 16/45

(58) Field of Search ..... 211/41.8, 41.9, 211/151, 181; 312/311, 301, 330.1, 334.1, 334.8–334.9, 334.12–334.15; 16/45, 18 R, 46–48, 22, 29–30, 37–39, 40, 43, 87 R, 97, 107

(56) References Cited

U.S. PATENT DOCUMENTS 1,639,860 A * 8/1927 Schultz ..... 16/45
2,488,222 A * 11/1949 Morgan ..... 16/363
2,948,914 A * 8/1960 Fitken, Jr. ..... 16/45
3,261,647 A * 7/1966 Stewart ..... 384/19
3,269,746 A * 8/1966 Jonker ..... 16/18 A
3,672,743 A * 6/1972 Pompey ..... 301/112
3,744,646 A * 7/1973 Duncan et al. ..... 211/151
3,822,437 A * 7/1974 Screen ..... 16/45
3,834,783 A * 9/1974 Jenkins ..... 312/311
4,019,794 A * 4/1977 Rowe ..... 312/311
4,057,872 A * 11/1977 Schmidt ..... 16/29
4,402,556 A * 9/1983 Schwind ..... 384/281
4,449,735 A * 5/1984 McDougall ..... 280/818
4,874,209 A * 10/1989 Spitzer et al. ..... 16/29
5,169,115 A * 12/1992 Chung Hsiang ..... 16/30
5,209,555 A * 5/1993 Camilleri ..... 312/311
5,351,837 A * 10/1994 Smith ..... 211/41.8
5,601,195 A * 2/1997 Finola et al. ..... 211/41.8
5,657,878 A * 8/1997 Austin ..... 211/41.8
5,709,008 A * 1/1998 Dickinson ..... 16/29

* cited by examiner

*Primary Examiner*—Daniel P. Stodola
*Assistant Examiner*—Jennifer E. Novosad
(74) *Attorney, Agent, or Firm*—Lowe Hauptman Gilman & Berner, LLP

(57) ABSTRACT

A dishwasher rack including a grille having longitudinal rods; and a number of wheels connected to the grille by respective supporting rods, each having a fastening portion and a bent end bent substantially at a right-angle so as to be located a minimum distance from a respective longitudinal rod. Each wheel includes a hub fitted to a respective bent end; and a spacing member projecting axially from and connected integrally to the respective hub to form a single component, and which is arrested against a respective longitudinal rod. Each spacing member extends to such an extent that an axial dimension of each wheel is greater than the aforementioned minimum distance.

20 Claims, 2 Drawing Sheets

Fig. 1
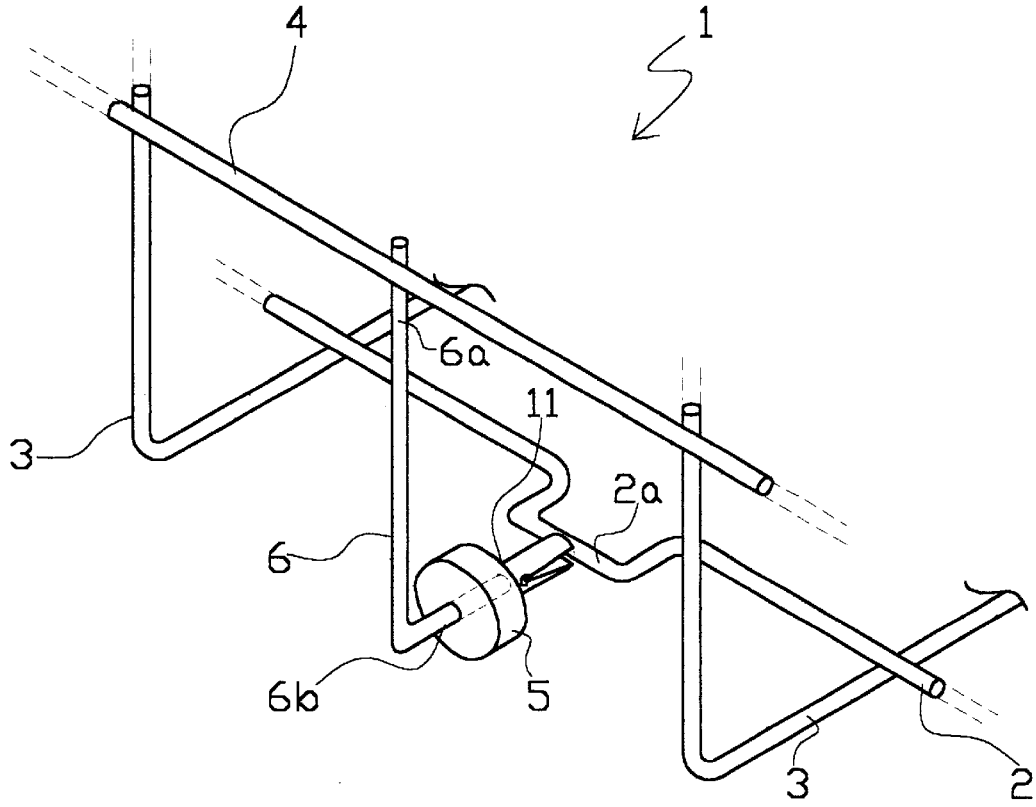
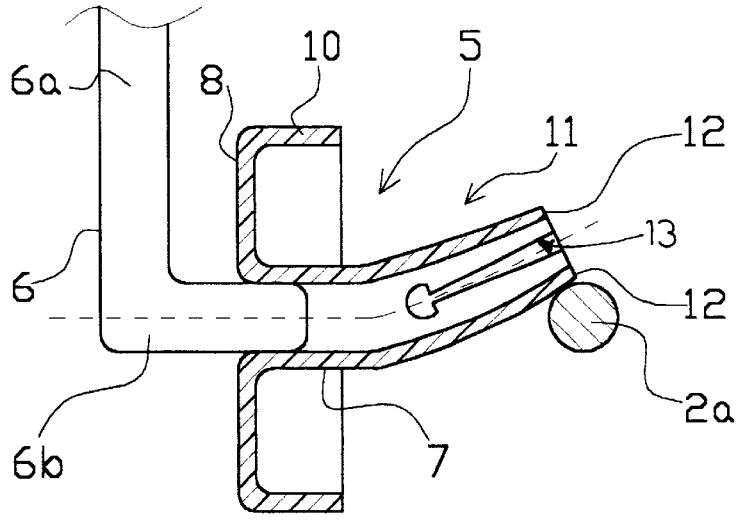
Fig. 2

MOVABLE RACK FOR AN ELECTRIC HOUSEHOLD APPLIANCE

The present invention relates to a movable rack for an electric household appliance, in particular a dishwasher, and to the relative wheels.

BACKGROUND OF THE INVENTION

As is known, dishwasher racks comprise a number of longitudinal and transverse rods welded to one another to form a grille, and are normally mounted on wheels for easy removal to load and unload the machine. The wheels are mounted on supporting rods having a vertical fastening portion fixed to the grille, and a bent L-shaped end projecting outwards of the rack.

More specifically, each wheel is connected to the respective supporting rod by a connecting member fitted to the bent end and retained by click-on retaining tabs cooperating with the vertical fastening portion. The connecting member also has a pin on to which the respective wheel is fitted.

The above system involves several drawbacks, one being the necessity to produce the wheel and the connecting member in two separate parts using two different industrial manufacturing processes. Also, the wheels must be preassembled to the respective connecting members prior to fixing the connecting members to the bend ends of the supporting rods.

SUMMARY OF THE INVENTION

It is an object of the present invention to provide a dishwasher rack designed to eliminate the aforementioned drawbacks, and which, in particular, is cheap and easy to produce.

According to the present invention, there is provided a movable rack for an electric household appliance, in particular a dishwasher, comprising a number of wheels connected to said rack by respective supporting rods, each having a fastening portion and a bent end bent substantially at a right-angle; said wheels comprising respective hubs connected to respective said bent ends; characterized in that said bent end of each of said supporting rods is located a predetermined distance from a respective longitudinal member of the rack; said wheels each comprising spacing means projecting axially from and connected integrally to a respective said hub to form a single component, and which are arrested against said longitudinal member of the rack; and said spacing means extending to such an extent that an axial dimension of each said wheel is greater than said predetermined distance.

More specifically, said spacing means comprise at least one elastic member.

The wheels may therefore be fitted straight on to the respective supporting rods, with no connecting members required, and may advantageously be formed in one piece using simpler, cheaper manufacturing processes.

BRIEF DESCRIPTION OF THE DRAWINGS

A number of non-limiting embodiments of the invention will be described by way of example with reference to the accompanying drawings, in which:

FIG. 1 shows a view in perspective of a portion of a dishwasher rack in accordance with the present invention;

FIG. 2 shows a partly sectioned side view of a detail of the FIG. 1 dishwasher rack according to a first embodiment of the present invention and at the assembly stage;

DETAILED DESCRIPTION OF THE INVENTION

Figure 3:
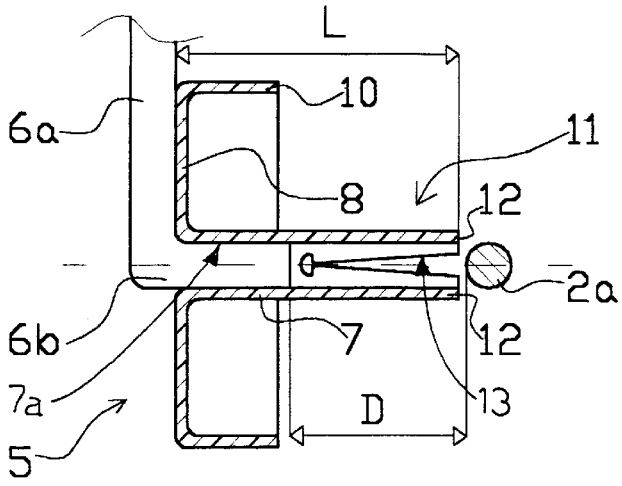
FIG. 3 shows a partly sectioned side view of the FIG. 2 detail at the end of the assembly stage.

As shown in FIG. 1, a dishwasher rack, shown only partly and indicated as a whole by 1, comprises a number of longitudinal rods 2, a number of transverse rods 3, and at least one peripheral rod 4 welded to one another to form a drawerlike grille.

Rack 1 also comprises a number of, e.g. four or six, wheels 5 fitted to respective supporting rods 6 as described below (for the sake of simplicity, only one wheel 5 and one supporting rod 6 are shown in FIG. 1).

Each supporting rod 6 is fixed to peripheral rod 4 of the rack by a respective vertical fastening portion 6*a,* and has a bent end 6*b* bent substantially at a right-angle with respect to portion 6*a* to form a pin about which respective wheel 5 rotates. Unlike known racks, each rod 6 is fitted to the rack so that the pin defined by bent end 6*b* projects inwards, as opposed to outwards, of the rack.

At least some of longitudinal rods 2 (e.g. the ones adjacent to wheels 5) conveniently comprise, at supporting rods 6 and wheels 5, portions bent to form loops 2*a* extending towards wheels 5.

With reference to FIG. 3, each wheel 5, made of polymer material, comprises a hub 7 and a disk 8 coaxial and formed in one piece with each other; and a cylindrical edge 10, formed in one piece with disk 8 and on which wheel 5 rolls, is connected to an outer edge of disk 8.

A spacing member 11 is formed in one piece with and projects axially from hub 7, and extends to such an extent that an axial dimension L of wheel 5 is greater than the minimum distance D between end 6*b* of supporting rod 6 and the loop 2*a* of the adjacent longitudinal rod 2. End 6*b* and/or loop 2*a* are/is so formed as to obtain a predetermined distance D.

According to the invention, spacing member 11 is so formed that at least part of its length is flexible elastically outside its plane.

More specifically, spacing member 11 is defined by two facing elastic appendixes 12 of hub 7, which extend on the opposite side to disk 8 and are separated by tapered V-shaped grooves or slits 13 (to form a so-called "clarinet reed" structure).

A through cylindrical cavity is formed in hub 7 and spacing member 11, and forms a through pivot seat 7*a* by which to fit wheel 5 on to end 6*b* of respective supporting rod 6.

Hub 7, disk 8, cylindrical edge 10 and spacing member 11 are therefore connected to one another to form a one-piece wheel 5 molded from appropriate synthetic plastic material.

As shown in FIG. 2, at the assembly stage, elastic appendixes 12 of spacing member 11 flex against loop 2*a* of longitudinal rod 2 to permit insertion of end 6*b* of supporting rod 6 inside through seat 13 of wheel 5.

In actual use (FIG. 3), wheel 5 is retained loosely between fastening portion 6*a* of supporting rod 6 and loop 2*a* of the adjacent longitudinal rod 2, and is fitted idly on to bent end 6*b*. More specifically, spacing member 11 is seated between loop 2*a* and portion 6*a* to prevent wheel 5 from sliding axially over and above the limited axial clearance allowed, and so prevent end 6*b* from withdrawing accidentally from through seat 13.

Figure 4:
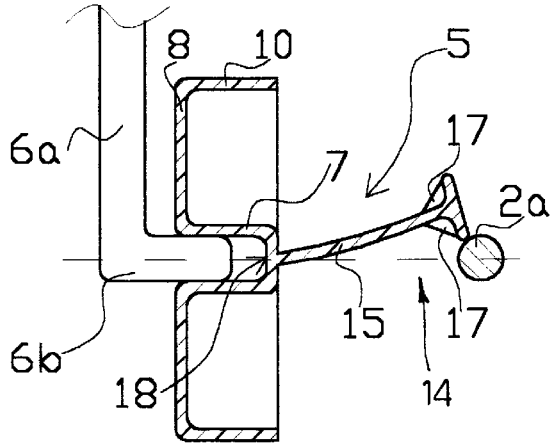
FIG. 4 shows a partly sectioned side view of a detail of the FIG. 1 dishwasher rack according to a second embodiment of the present invention and at the assembly stage.
Figure 5:
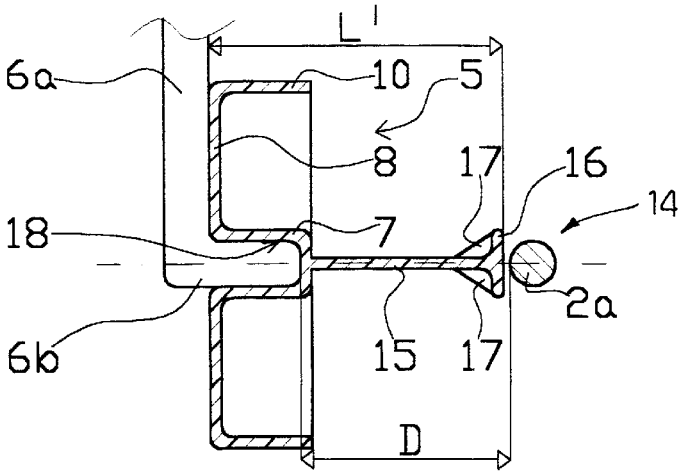
FIG. 5 shows a partly sectioned side view of the FIG. 4 detail at the end of the assembly stage.

FIGS. 4 and 5 show a further embodiment of the invention, wherein any details similar to or identical with those already described are indicated using the same reference numbers for the sake of simplicity. Wheel 5 comprises hub 7, disk 8 and cylindrical edge 10 as in FIGS. 2 and 3, but differs by comprising a spacing member 14 defined by an elastic stem 15 and a stop pad 16.

More specifically, stem 15 is formed in one piece with hub 7, projects axially from hub 7 in the opposite direction to the assembly direction of wheel 5, and extends to such an extent that an axial dimension L' of wheel 5 is greater than the minimum distance D between end 6*b* of supporting rod 6 and the loop 2*a* of the adjacent longitudinal rod 2.

Pad 16 is formed in one piece with the end of stem 15, and is substantially perpendicular to the major dimension of stem 15; and connecting tabs 17 connect pad 16 to stem 15 to assist assembly of wheel 5 and to prevent pad 16 from jamming on loop 2*a* (FIG. 4).

A dead cylindrical cavity is formed in hub 7, and forms a dead seat 18 by which to fit wheel 5 on to end 6*b* of respective supporting rod 6. More specifically, stem 15 projects from an end wall of and on the opposite side to dead seat 18.

Hub 7, disk 8, cylindrical edge 10 and spacing member 14 are therefore connected to one another to form a one-piece wheel 5 molded from appropriate synthetic plastic material.

In this case, too, wheel 5, in actual use, is retained loosely between fastening portion 6*a* of supporting rod 6 and loop 2*a* of the adjacent longitudinal rod 2, and is fitted idly on to portion or bent end 6*b*. More specifically, stem 15 and pad 16, when arrested against loop 2*a*, prevent wheel 5 from sliding axially and end 6*b* from withdrawing accidentally from dead seat 18.

Clearly, changes may be made to the dishwasher rack as described herein without, however, departing from the scope of the present invention.

What is claimed is:

1. A movable rack for a dishwasher, comprising:

a drawer structure having supporting rods; and a plurality of wheels (5) connected to said drawer structure by the respective supporting rods (6) of said drawer structure;

each of said supporting rods having a fastening portion (6*a*) and a bent end (6*b*) bent substantially at a right angle with respect to the fastening portion;

each of said wheels comprising a hub (7) connected to the respective bent end (6*b*); wherein each of said bent ends (6*b*) is located at a predetermined distance (D) from a respective longitudinal member (2) of the drawer structure;

each of said wheels further comprises spacing means (11; 14) projecting axially from and connected integrally to the respective hub (7) to form a single component, said spacing means being arrested against the respective longitudinal member (2) of the drawer structure, and said spacing means (11; 14) extending to such an extent that an axial dimension (L; L') of said wheel (5) is greater than said predetermined distance (D).

2. The rack as claimed in claim 1, wherein said spacing means comprise at least one elastic member (12; 15).

3. The rack as claimed in claim 1, wherein said spacing means (11) comprise two elastic appendixes (12) of said hub (7).

4. The rack as claimed in claim 1, wherein said spacing means (14) comprise an elastic stem (15) terminating with a stop pad (16).

5. The rack as claimed in claim 1, wherein the drawer structure is a grille (2, 3, 4) having longitudinal (2) and transverse (3) rods;

said longitudinal members being defined by respective longitudinal rods (2) that are adjacent to said wheels (5).

6. The rack as claimed in claim 5, wherein each of the longitudinal rods that defines one of said longitudinal members has a portion bent to form a loop (2*a*);

said spacing means (11; 14) of the respective wheel being arrested against said loop (2*a*).

7. A rack movable in a longitudinal direction thereof, said movable rack comprising:

a drawer structure having a bottom and side walls extending upwardly from said bottom, said drawer structure further comprising a plurality of supporting rods and at least one longitudinal member; and a plurality of wheels connected to said drawer structure by the respective supporting rods; wherein each of said supporting rods has a fastening portion attached to and extending along one of said side walls, and a bent end bent at an angle with respect to the fastening portion, said bent end extending inwardly with respect to said one of said side walls and generally in a transverse direction of said rack;

each of said wheels comprises a hub connected to the respective bent end.

8. The rack as claimed in claim 7, wherein each of said wheels is retained between the fastening portion of the respective supporting rod and said at least one longitudinal member.

9. The rack as claimed in claim 8, wherein an innermost point of said bent end is located at a predetermined distance, as measured in the transverse direction of said rack, from said at least one longitudinal member, while a transverse extent of the respective wheel is greater than said predetermined distance.

10. The rack as claimed in claim 9, wherein each of said wheels further comprises a spacing element projecting, in the transverse direction, from the respective hub (7) toward said at least one longitudinal member, said spacing element being arrested against said at least one longitudinal member.

11. The rack as claimed in claim 10, wherein each of said wheels, including the respective spacing element and hub, is integrally formed as a single molded component.

12. The rack as claimed in claim 10, wherein said spacing element is a flexible member.

13. The rack as claimed in claim 10, wherein said spacing element is a continuous extension of said hub and defines, together with said hub, a hollow tube.

14. The rack as claimed in claim 13, wherein said spacing element has at least one slit extending from an innermost end of said spacing element towards said hub.

15. The rack as claimed in claim 14, wherein a width of said slit gradually decreases towards said hub.

16. The rack as claimed in claim 10, wherein said hub is a cylindrical cavity having a bottom wall at a closed end thereof, said spacing element includes a stem extending from the bottom wall of said cavity toward said longitudinal member and ending at an enlarged stop pad.

17. The rack as claimed in claim 16, wherein a portion of said stem that is contiguous to said enlarged stop pad has a width gradually increasing towards said stop pad for preventing the stop pad from jamming on said at least one longitudinal member.

18. The rack as claimed in claim 7, wherein said drawer structure is a grille comprising longitudinal rods and transverse rods together defining said bottom, and upright rods and peripheral rods together defining said side walls;

one of said longitudinal rods defining said at least one longitudinal member.

19. The rack as claimed in claim 18, wherein said at least one longitudinal member is an outermost one among said longitudinal rods, said at least one longitudinal member has at least a portion bent to form a loop that extends toward one of said wheels so as to retain the wheel between the fastening portion of the respective supporting rod and the loop of said at least one longitudinal member.

20. The rack as claimed in claim 19, wherein each of said wheels is displaceable in the transverse direction of said rack between limits defined by the fastening portion of the respective supporting rod and said at least one longitudinal member.

* * * * *